United States Patent [19]

Fehler

[11] 4,432,115

[45] Feb. 21, 1984

[54] JOINTER FOR COMPACTING AND SMOOTHING MORTAR JOINTS OF MASONRY WALLS

[76] Inventor: Henry P. Fehler, P.O. Box 194, Wolseley, Saskatchewan, Canada, S0G 5H0

[21] Appl. No.: 397,225

[22] Filed: Jul. 12, 1982

[30] Foreign Application Priority Data

Feb. 5, 1981 [CA] Canada ..... 370148

[51] Int. Cl.[3] ..... E04G 21/20

[52] U.S. Cl. ..... 15/105.5; 15/235.3

[58] Field of Search ..... 15/105.5, 235.3; 404/89

[56] References Cited

U.S. PATENT DOCUMENTS

| | | | |
|---|---|---|---|
| 1,014,650 | 1/1912 | Kline | 15/105.5 |
| 1,037,105 | 8/1912 | Baugh | 15/105.5 |
| 1,193,478 | 8/1916 | Downs | 15/105.5 X |
| 1,436,254 | 11/1922 | Henry, Jr. | 15/105.5 |
| 1,445,021 | 2/1923 | Johnson | 15/105.5 |
| 1,683,373 | 9/1928 | Ross et al. | 15/105.5 |
| 2,883,854 | 4/1959 | Marmon | 15/235.3 |
| 3,109,189 | 11/1963 | Eldridge, Jr. | 15/105.5 |
| 3,155,997 | 11/1964 | Gallagher | 15/105.5 |

FOREIGN PATENT DOCUMENTS

| | | |
|---|---|---|
| 57374 | 9/1897 | Canada . |
| 180668 | 11/1917 | Canada . |
| 496236 | 9/1953 | Canada . |

OTHER PUBLICATIONS

Time/Life Book on Masonry, First Printing 1976, pp. 10 and 11.

*Primary Examiner*—Chris K. Moore

*Attorney, Agent, or Firm*—Stevens, Davis, Miller & Mosher

[57] ABSTRACT

A jointer for smoothing mortar joints has an elongate handle and offset trowel portion at each end. Each trowel portion is shaped to gradually decrease in width toward its free end and is convexly curved to enable the use of one tool for a number of joints of different width. One trowel portion is shorter than the other to improve the convenience in compacting head joints. Both blades are offset to the same side of a centerline of elongation of the handle. The tool provides a simple and inexpensive improvement by rendering the tool suitable for different widths of the joint while also improving the convenience of working with the tool.

16 Claims, 3 Drawing Figures

JOINTER FOR COMPACTING AND SMOOTHING MORTAR JOINTS OF MASONRY WALLS

BACKGROUND OF THE INVENTION

The present invention relates to a jointer for compacting and smoothing mortar joints of masonry walls. Jointers are well known in the building industry as being used for compacting mortar in joints, for instance, in a brick wall. Many different types of jointers have been suggested, among which so-called raking tool can be referred to as one example. The raking tool is provided with a generally smooth surface protruding outwardly from a flat guiding surface. The protruding portion is designed to enter the joint and to compact mortar therein while simultaneously smoothing its surface. It is also known to provide convex jointers having two generally straight and parallel portions each disposed at transverse spacing from the other. The convex jointer has a convexly curved straight surface, and its use results in a straight, convexly curved joint, as opposed to a generally flat surface of the joint provided by the raking tool. A modification of the convex jointer is so-called V-jointer which provides a surface of the joint having, in transverse cross-section, the shape of a V. The raking tool provides a deep recess, which is, generally, formed by scraping off a part of the mortar in the joint. It is disadvantageous when it is desired to produce a joint that would be weatherproof. If the joint is to be weatherproof, then concave or V-shaped joint is preferred, not only because of its shape, directing water out of the joint, but also due to the fact that the mortar within the joint is compacted.

The disadvantage of the concave or V-jointers so far in use is that they are designed for a predetermined width of the joint. If the desired width of the joint is smaller or greater than the particular jointer, then the tool cannot be used satisfactorily; if it is too wide for the joint, it is virtually inoperative, and if it is too narrow for a particular joint, then the compacting function of the tool is not satisfactory as "bleeding" of mortar occurs to one or both sides of the jointer.

SUMMARY OF THE INVENTION

It is an object of the present invention to provide a jointer which would avoid the above deficiencies of a compacting jointer by rendering the tool suitable for a more universal application. Another object of the present invention is to provide a tool which would have substantially improved convenience, particularly from the standpoint of application for both horizontal mortar lines, and for head joints. Another object of the invention is to provide a tool of the described type wherein the danger of inadvertent touching of the surface of the bricks by hand while guiding the jointer is reduced.

In accordance with the present invention, a jointer is provided for compacting and smoothing mortar joints of masonry walls, of the type comprising, in combination: an elongate handle; a first smoothing trowel portion at one end of said handle and fixedly secured to same; a second smoothing trowel portion at the other end of said handle and fixedly secured to same; at least one of said first and second trowel portions having an elongate smoothing surface whose width gradually decreases in the direction away from the respective end of said handle; said first trowel portion being convexly curved along an arcuate line generally coplanar with the axis of elongation of said handle but offset relative to said axis.

The convergent shape of the smoothing trowel portion makes it possible to use one tool for different widths of the joint.

Preferably, the first trowel portion terminates at a beveled free end edge sloping forwardly at an acute angle with respect to said smoothing surface, to provide the tip of the tool with the capability of cutting out excess mortar from the joint.

The second trowel portion is of the same basic configuration, i.e. is convexly curved and provided with a beveled tip as the first trowel portion. It is preferred that the second portion be shorter than the first portion, whereby the second portion is particularly suitable for head joints.

Many variation of the basic concept of the present invention may exist, the broad concept being typical by a jointer for smoothing mortar joints of masonry walls of the type comprising, in combination: an elongate handle; a smoothing trowel portion at one end of said handle and fixedly secured to same; said smoothing trowel portion having an elongate smoothing surface whose width gradually decreases in the direction away from said handle; said smoothing trowel portion being convexly curved along an arcuate line generally coplanar with the axis of elongation of said handle but offset relative to said axis. In other words, even though in the preferred embodiment the jointer of the present invention has two smoothing trowel portions, it is readily conceivable that the present invention also includes a tool having merely a single trowel portion as long as the inventive features as outlined in the foregoing general definition are present.

BRIEF DESCRIPTION OF THE DRAWINGS

The present invention will be described in greater detail with reference to the accompanying drawing, wherein.

DETAILED DESCRIPTION OF A PREFERRED EMBODIMENT

Figure 1:
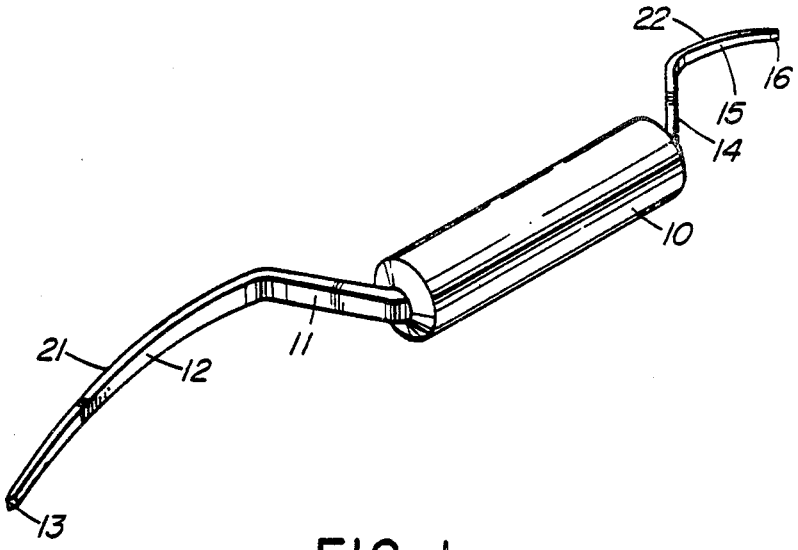
FIG. 1 is a perspective view of a preferred embodiment of the present invention.

A jointer shown in the drawing is made of an elongate blank of suitable metallic material and comprises an elongate generally cylindrical handle 10, preferably made from a plastic material. At one end of handle 10, the blank forms a first shoulder portion 11 which merges, at its end remote from the handle 10, with a first smoothing trowel portion 12 the free end of which has a beveled tip 13.

From the opposite end of the handle 10 protrudes a shoulder 14 merging at its end remote from the handle 10, with a second trowel portion 15 also having a beveled tip 16.

Figure 3:
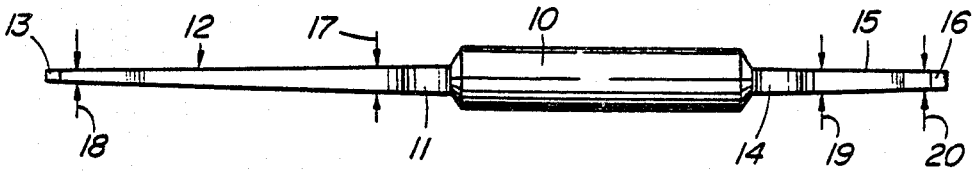
FIG. 3 is a top view of FIG. 2.

As best seen from FIG. 3, the width of the first and second trowel portions 12, 15 gradually decreases in the direction away from the respective end of the handle 10. Typically, the width 17 of the first trowel portion 12 near its merger with the shoulder 11 is about 5/16" while the width 18 near the beveled tip 13 is approximately 5/32". The overall length of the first trowel portion is approximately 7¾".

On the other hand, the width 19 of the second trowel portion near its merger with the shoulder 14 is approximately 5/16" while the tip portion thereof has the width 20 of about 3/16", the overall length of the second trowel portion being about 1 7/8".

Figure 2:
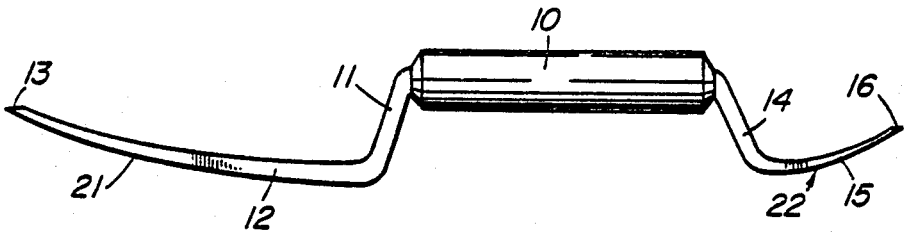
FIG. 2 is a side view thereof.

As best shown in FIGS. 1 and 2, the first trowel portion 12 defines a convexly curved smoothing surface 21. As best seen on comparing FIGS. 2 and 3, the convex curvature of the smoothing surface 21 is generally coplanar with elongation of the handle 10. In other words, the curvature is within a plane passing centrally through the elongation of handle 10 in FIG. 3 and perpendicular to the surface of the drawing of FIG. 3. The surface 21, of course, is offset to one side, (downwardly in FIG. 2) with respect to the axis of elongation of handle 10. The second trowel portion 15 is also convexly curved to form a convexly curved smoothing surface 22 such that the central curve defining curvature of the surface 22 is generally coplanar with the above-mentioned plane perpendicular to the surface of the drawing of FIG. 3.

The present invention thus provides an extremely simple tool providing improvement over known jointers. First, the combination of the convexly curved surfaces 21 or 22 with the decreasing width of each respective smoothing surface 21 or 22 presents a more universal application as the tool can be used for a variety of different widths of the joint by simply slightly tilting the tool within the plane perpendicular to the drawing of FIG. 3, thus rendering a different part of the respective trowel portion 12, 15 engaged with the surface of the mortar to be compacted in the joint.

The offset arrangement of the smoothing surfaces 21, 22 to the same side of the axis of elongation of handle 10 provides an additional convenience due to making it virtually impossible to inadvertently touch the bricks or the like surface of the building wall, as that one of the surfaces 21, 22 which is not instantly being used forms a support securing that there is always a minimum required spacing for fingers beneath the handle 10, as viewed in FIG. 2 and the wall.

The beveled tips 13, 16 provide an additional convenience of readily cutting out excess mortar from the joint.

Those skilled in the art will readily appreciate that different modifications departing to a greater or lesser degree from the preferred embodiments shown in the drawings may exist without departing from the present invention as defined in the accompanying claims. For instance, the degree of bevel may be somewhat different from that shown in the drawings and referred to above, even though the bevel as shown is preferred. Another example is in the actual embodiment of the handle portion. Those skilled in the art will readily appreciate that the handle 10 from a plastic material can be totally omitted and indeed it may prove to be feasible to make the entire tool as an integral unit from a single blank of material wherein the central portion would form the handle itself, without any additional material.

The embodiments of the invention in which an exclusive property or privilege is claimed are defined as follows:

1. A jointer for compacting and smoothing mortar joints of masonry walls, of the type comprising, in combination:

(a) an elongate handle;

(b) a first smoothing trowel portion at one end of said handle and fixedly secured to same;

(c) a second smoothing trowel portion at the other end of said handle and fixedly secured to same;

(d) at least one of said first and second trowel portions having an elongate smoothing surface whose width gradually decreases in the direction away from the respective end of said handle;

(e) said first trowel portion being convexly curved along an arcuate line generally coplanar with the axis of elongation of said handle but offset relative to said axis.

2. A jointer as claimed in claim 1, wherein said first trowel portion terminates at a beveled free end edge sloping forwardly at an acute angle with respect to said smoothing surface.

3. A jointer as claimed in claims 1 or 2 wherein said second trowel portion is convexly curved along an arcuate line generally coplanar with the axis of elongation of said handle but offset relative to said axis.

4. A jointer as claimed in claims 1 or 2 wherein said second trowel portion is convexly curved along an arcuate line generally coplanar with the axis of elongation of said handle but offset relative to said axis, said second trowel portion terminating at a beveled free end edge sloping at an acute angle with respect to a portion of said arcuate line at said free end edge.

5. A jointer as claimed in claim 1 or 2 wherein said second trowel portion is convexly curved along an arcuate line generally coplanar with the axis of elongation of said handle but offset relative to said axis, both said trowel portions being offset to the same side of said axis.

6. A jointer as claimed in claims 1 or 2 wherein said second trowel portion is convexly curved along an arcuate line generally coplanar with the axis of elongation of said handle but offset relative to said axis, both said trowel portions being offset to the same side of said axis wherein said second trowel portion is shorter than said first trowel portion.

7. A jointer for smoothing mortar joints of masonry walls of the type comprising in combination:

(a) an elongate handle;

(b) a smoothing trowel portion at one end of said handle and fixedly secured to same;

(c) said smoothing trowel portion having an elongate smoothing surface whose width gradually decreases in the direction away from said handle;

(d) said smoothing trowel portion being convexly curved along an arcuate line generally coplanar with the axis of elongation of said handle but offset relative to said axis.

8. A jointer as claimed in claim 7, wherein said trowel portion terminates at a beveled free end edge sloping forwards at an acute angle with respect to said smoothing trowel portion.

9. A jointer for compacting and smoothing mortar joints of masonry walls, of the type comprising, in combination:

(a) an elongate handle;

(b) a first smoothing trowel portion at one end of said handle and integral with same;

(c) a second smoothing trowel portion at the other end of said handle and integral with same;

(d) at least one of said first and second trowel portions having an elongate smoothing surface whose width gradually decreases in the direction away from the respective end of said handle;

(e) said first trowel portion being convexly curved along an arcuate line generally coplanar with the axis of elongation of said handle but offset relative to said axis.

10. A jointer as claimed in claim 9, wherein said first trowel portion terminates at a beveled free end edge sloping forwardly at an acute angle with respect to said smoothing surface.

11. A jointer as claimed in claims 9 or 10 wherein said second trowel portion is convexly curved along an arcuate line generally coplanar with the axis of elongation of said handle but offset relative to said axis.

12. A jointer as claimed in claims 9 or 10 wherein said second trowel portion is convexly curved along an arcuate line generally coplanar with the axis of elongation of said handle but offset relative to said axis, said second trowel portion terminating at a beveled free end edge sloping at an acute angle with respect to a portion of said arcuate line at said free end edge.

13. A jointer as claimed in claims 9 or 10 wherein said second trowel portion is convexly curved along an arcuate line generally coplanar with the axis of elongation of said handle but offset relative to said axis, both said trowel portions being offset to the same side of said axis.

14. A jointer as claimed in claims 9 or 10 wherein said second trowel portion is convexly curved along an arcuate line generally coplanar with the axis of elongation of said handle but offset relative to said axis, both said trowel portions being offset to the same side of said axis wherein said second trowel portion is shorter than said first trowel portion.

15. A jointer for smoothing mortar joints of masonry walls of the type comprising in combination:

(a) an elongate handle;

(b) a smoothing trowel portion at one end of said handle and integral with same;

(c) said smoothing trowel portion having an elongate smoothing surface whose width gradually decreases in the direction away from said handle;

(d) said smoothing trowel portion being convexly curved along an arcuate line generally coplanar with the axis of elongation of said handle but offset relative to said axis.

16. A jointer as claimed in claim 15, wherein said trowel portion terminates at a beveled free end edge sloping forwards at an acute angle with respect to said smoothing trowel portion.

* * * * *